US009863708B2

(12) United States Patent
Zivanovic et al.

(10) Patent No.: US 9,863,708 B2
(45) Date of Patent: Jan. 9, 2018

(54) REFRACTORY CERAMIC GAS PURGING ELEMENT

(71) Applicant: Refractory Intellectual Property GmbH & Co. KG, Vienna (AT)

(72) Inventors: Bojan Zivanovic, Vienna (AT); Bernhard Handle, Vienna (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 74 days.

(21) Appl. No.: 14/913,625

(22) PCT Filed: Mar. 2, 2015

(86) PCT No.: PCT/EP2015/054285
§ 371 (c)(1),
(2) Date: Feb. 22, 2016

(87) PCT Pub. No.: WO2015/169466
PCT Pub. Date: Nov. 12, 2015

(65) Prior Publication Data

US 2016/0209117 A1 Jul. 21, 2016

(30) Foreign Application Priority Data

May 5, 2014 (EP) ..... 14167036

(51) Int. Cl.
*B22D 41/08* (2006.01)
*F27D 17/00* (2006.01)
(Continued)

(52) U.S. Cl.
CPC ..... *F27D 17/002* (2013.01); *C21C 5/4673* (2013.01); *C21C 5/48* (2013.01);
(Continued)

(58) Field of Classification Search
CPC ..... B22D 1/005
(Continued)

(56) References Cited

U.S. PATENT DOCUMENTS 4,938,459 A 7/1990 Cingle, III
4,971,295 A * 11/1990 Rothfuss ..... B22D 1/005 266/220

FOREIGN PATENT DOCUMENTS

DE 19755199 C1 11/1998
DE 20100976 U1 12/2001
(Continued)

*Primary Examiner* — Scott Kastler
(74) *Attorney, Agent, or Firm* — Medley, Behrens & Lewis, LLC

(57) ABSTRACT

Refractory ceramic gas purging element, comprising: a refractory ceramic body, a chamber is arranged at the first end (10*u*) of the refractory ceramic body (10), which chamber extends over at least 50% of the cross section of the refractory ceramic body at its first end, a gas feeding line enters into said chamber, at a distance to said refractory ceramic body, at a section towards the refractory ceramic body the chamber is at least partially permeable to gas, the chamber comprises at least one plate, which is freely moveable in an axial direction of the gas purging element between a first end position and a second end position, the plate is dimensioned, shaped and placed in the chamber such that a gas flow from the gas feeding line through said chamber up to the first end is even secured when the plate is in its second end position.

15 Claims, 3 Drawing Sheets

Figure 1:
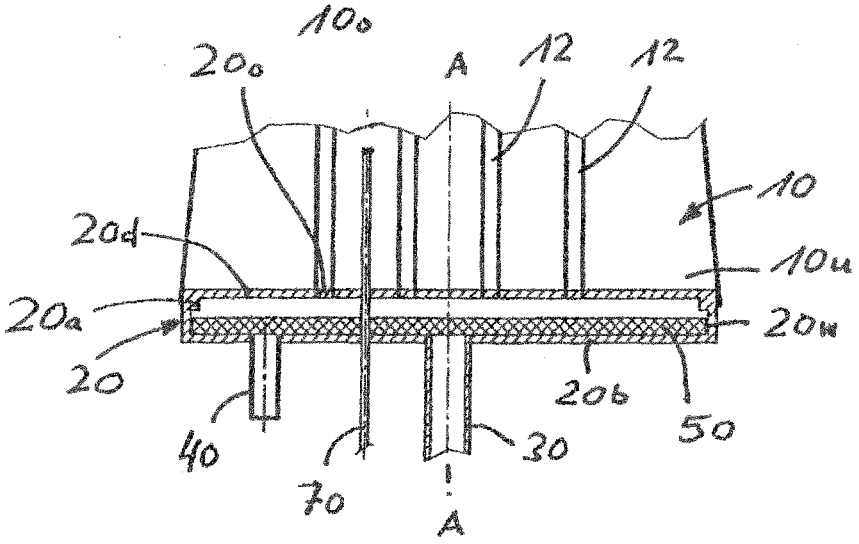

(51) Int. Cl.

| | |
|---|---|
| ***C21C 5/46*** | (2006.01) |
| ***C21C 5/48*** | (2006.01) |
| ***C22B 9/05*** | (2006.01) |
| ***F27D 3/16*** | (2006.01) |
| ***F27D 9/00*** | (2006.01) |
| *C21C 7/072* | (2006.01) |

(52) U.S. Cl.
CPC ..... *C22B 9/05* (2013.01); *F27D 3/16* (2013.01); *F27D 9/00* (2013.01); *C21C 7/072* (2013.01); *F27D 2003/161* (2013.01)

(58) Field of Classification Search
USPC ..... 266/220
See application file for complete search history.

(56) References Cited

FOREIGN PATENT DOCUMENTS

| | | | |
|---|---|---|---|
| JP | 2010189687 | A | 9/2010 |
| WO | 0148337 | A1 | 7/1985 |
| WO | 2015169466 | A1 | 11/2015 |

* cited by examiner

REFRACTORY CERAMIC GAS PURGING ELEMENT

The invention relates to a refractory ceramic gas purging element, i. e. a gas purging installation, in particular for metallurgical vessels, in which metal melts are treated, for example a ladle or a tundish. Such vessels/aggregates include those for non-iron metals such as lead.

A generic gas purging installation, of the type as known from DE 197 55 199 C1, comprises a refractory ceramic gas purging brick and a gas distribution chamber, arranged at the bottom of the gas purging brick, from which gas permeable sections extend through the gas purging brick to the gas outlet side of the gas purging brick. The gas purging installation further comprises a gas feeding pipe, which merges with a gas outlet opening into said gas distribution chamber.

A treating gas or a gas-/solid-mixture is blown into the metal melt by using such gas purging installation.

If the gas pressure decreases and/or the gas purging element becomes shorter (in particular by wear caused by a metallurgical attack) the risk of an infiltration of the metal melt into said gas purging element or through said gas purging element respectively exists.

To reduce such risk DE 197 55 199 C1 provides for a cover within said gas distribution chamber, which is fixed with one section at the gas distribution chamber and with another, freely moveable section, it overlaps the outlet opening of the gas feeding pipe. Under normal gas pressure the gas pushes the cover away and the gas may flow via the gas distribution chamber and the porous section of the gas purging brick into the metal melt. Under reduced pressure and in cases, when a gas flow is interrupted, said moveable part of the cover will lie on the gas outlet side opening of the gas feeding pipe like a closure and seal the gas feeding pipe.

The known gas purging installation has proved successful but needs a flexible (elastic) cover, for example made of a thin metal sheet. The functionality of the cover may be reduced under frequent changes of the gas pressure or under higher temperatures in the gas distribution chamber.

Insofar it is an object of the invention to provide a refractory ceramic gas purging element of the generic type, which is highly safe against failures even if the gas pressure varies and/or the ceramic part of the gas purging element is partly worn.

The invention starts from a refractory ceramic gas purging element, comprising the following features:

- the gas purging element has a refractory ceramic body, through which a gas can flow in an axial direction (A-A) of the gas purging element, between its first end and a second end,
- a chamber is arranged at the first end of the refractory ceramic body, which chamber extends over at least 50% of the cross-section of the refractory ceramic body at its first end,
- a gas feeding line enters into said chamber, at a distance to said refractory ceramic body,
- the chamber is at least partially permeable to gas towards the refractory ceramic body.

This corresponds to construction of a gas purging installation according to DE 197 55 199 C1.

In contrast to the known gas purging element the new gas purging element further comprises the following features:

- In the chamber at least one plate is arranged, which is freely moveable in the axial direction (A-A) of the gas purging element between a first end position, being offset to the refractory ceramic body and a second end position, being adjacent but at a distance to a section of the refractory ceramic body, which is permeable to gas,
- the plate is dimensioned, shaped and placed in said chamber in such a way, that a gas flow from the gas feeding line through said chamber up to the first end of the refractory ceramic body is even secured (guaranteed) when the plate is in its second end position.

The decisive difference to the gas purging means according to DE 197 55 199 C1 is the existence of a loose (non fixed) plate within the gas distribution chamber while according to the known arrangement a cover is fixed to said chamber.

According to the invention the plate moves within the gas distribution chamber between a first end position (for example when the gas is disconnected) and a second end position (under regular gas pressure), namely in particular in an axial direction of the gas-purging element, i. e. in the main direction, along which the gas flows through the ceramic part of the gas purging element.

It is important that the gas may also flow through the gas distribution chamber into the gas permeable part of the refractory ceramic body if the plate is in its (lifted, upper) second end position. Therefore the plate, in its second end position, should have a distance to the part of the refractory ceramic body, through which the gas flows.

Thereby the upper part of the gas distribution chamber (seen in the direction of the regular gas flow) remains open (clear) and avoids that the plate abuts (lies against/touches) directly against the lower side of the refractory ceramic body.

According to one embodiment the chamber extends over at least 90% of the cross-section of the refractory ceramic body at its first end. Typically the gas distribution chamber features a nearly identical cross-section compared with the adjacent refractory body, meaning that both extend in a flushed manner in an axial direction.

The chamber can be made from a metal box.

According to an embodiment the gas feeding line merges (enters) into a section of the chamber, which is opposite to the refractory ceramic body. When the gas purging element is regarded in a position, as typically installed in the bottom of a metallurgical vessel, then the gas feeding pipe enters into the chamber from below. This orientation of the gas purging element is valid as well in the following description if not otherwise disclosed.

From this it turns out that the moveable plate covers the gas feeding pipe, if the gas pressure is below a minimum value necessary to push the plate upwardly. In this lower position the plate fulfils a security function to avoid a potential infiltration of a metal melt. If a metal melt should enter the chamber it will first be stopped by said plate.

In case of a porous plate, in particular a plate of open porosity, the said plate may even suck in the metal melt. It is further avoided that the melt enters the gas feeding pipe.

The second end position, which is the upper position of the plate, can be defined by one or more stoppers (body stops), providing a free space (tolerance) between the plate and the first (lower) end of the refractory ceramic body.

This at least one stopper can protrude from the first end of the refractory ceramic body towards the plate; it is possible as well that the at least one body stop is arranged at the inside of said chamber, preferably close to the ceramic body. It is further possible to arrange the stopper(s) at the plate itself, for example by protruding knobs or ridges on that side of the plate facing the ceramic body.

The cross-section (base area) of the plate is always slightly smaller than the inner cross-section of the chamber to allow the said movability of the plate in an axial direction of the gas purging installation.

Preferably the plate is designed such that a mostly continuous gap remains between the periphery of the plate and the inner wall of the chamber. This gap is dimensioned to allow a good movability of the plate without tilting.

This is true in particular if the plate itself is impermeable to gas. In this case the gas flows around the plate before it enters into the free space between the plate and the first end of the ceramic refractory body and from there through the ceramic and gas permeable ceramic body.

The ceramic body can feature a so-called random porosity and/or directed porosity. "Random/irregular porosity" is characterized by a sponge-like structure, wherein the gas flow features a zig-zag pattern along the open pores through the ceramic. In case of a "directed porosity" the gas flow occurs mostly linear according to defined channels, slits or the like. The channels mostly extend in an axial direction of the purging element.

The plate may also be at least partially permeable to gas.

The gas permeability may be achieved in various ways.

In its most simple embodiment the plate features several discrete openings, through which a gas may flow. The openings may be evenly distributed along the area to allow an even gas flow into the gas permeably part of the body.

The plate may also feature a kind of a sponge structure, i. e. a type of "random porosity". In this case the plate may be made of the sinter metal or of a refractory ceramic part of random (undirected) porosity.

In order to secure the functionality of this security means (gas distribution chamber with moveable plate) even in critical situations one embodiment proposes to cool the chamber.

For this purpose the chamber may display a valve, to which a cooling gas pipe is fitted. The chamber may also feature a wall, which is part of a cooling device. For example the bottom of the chamber may be designed in a double-walled manner with a cooling fluid flowing therethrough.

According to a further embodiment the plate has at least one opening, which is penetrated by a bar, extending in the axial direction of the gas purging element, wherein the opening has a cross-section which is slightly larger than the cross-section of the bar.

This bar can fulfill various functions: Firstly the bar serves to guide the plate in an axial direction of the gas purging element.

At the same time the bar can fulfill further functions. For example the bar can provide a thermal element, with which the temperature within the gas purging element is detected.

The bar may further serve to detect the residual thickness. For example the bar can be designed as a hollow bar, wherein its end arranged within the ceramic body is closed. If said hollow bar is set under gas pressure and if the ceramic body is worn to a degree where the closed end of the hollow bar melts the gas may escape, the gas pressure then lowers and the corresponding wear is detected.

Further features of the invention derive from the features of the sub claims as well as from the other application documents.

The invention will be further described in the following according to various embodiments, displaying, in a schematic way—in FIG. 1: a longitudinal section through a first embodiment of a gas purging element with no gas flow.

Figure 2:
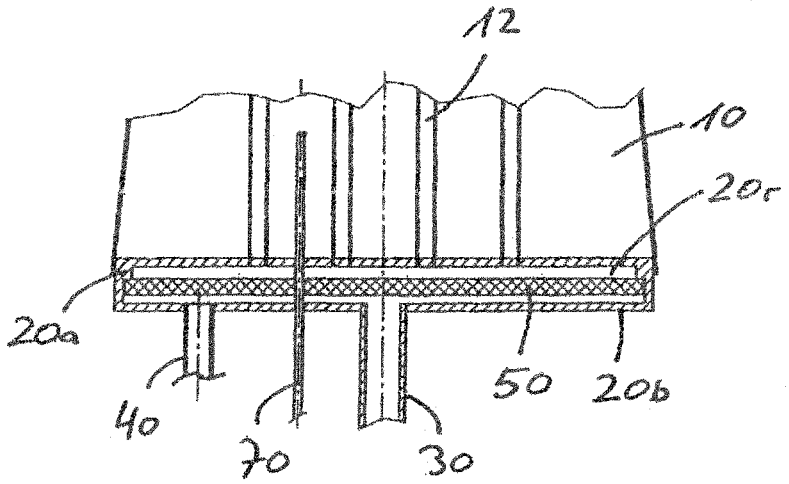

FIG. 2: as before, but under normal gas pressure in use.

Figure 3:
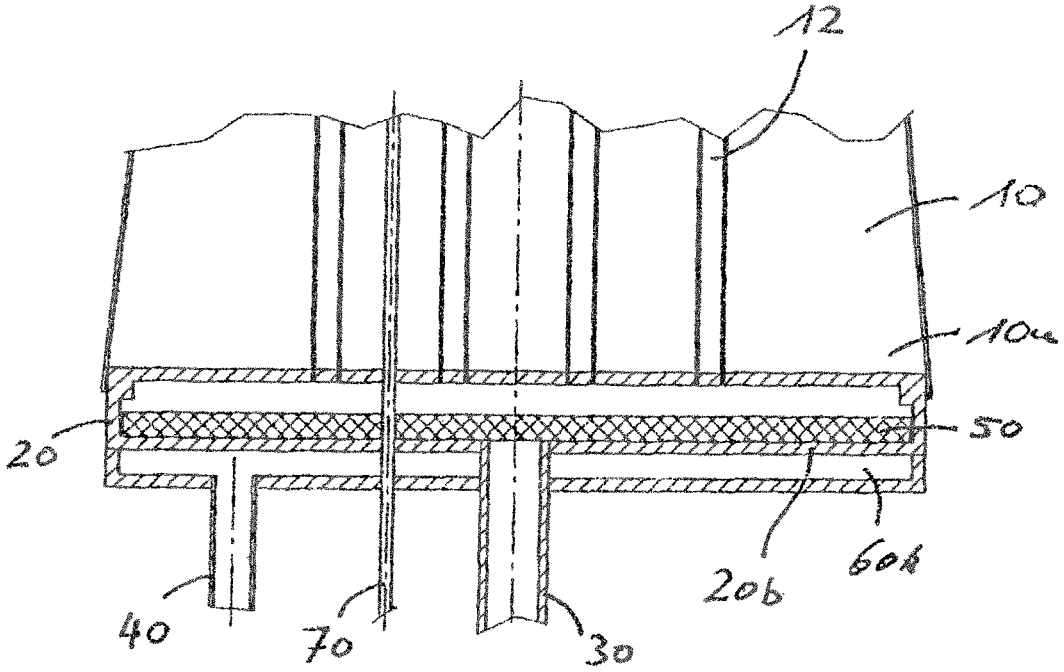

FIG. 3: a representation according to claim 1, but for a second embodiment.

Figure 4:
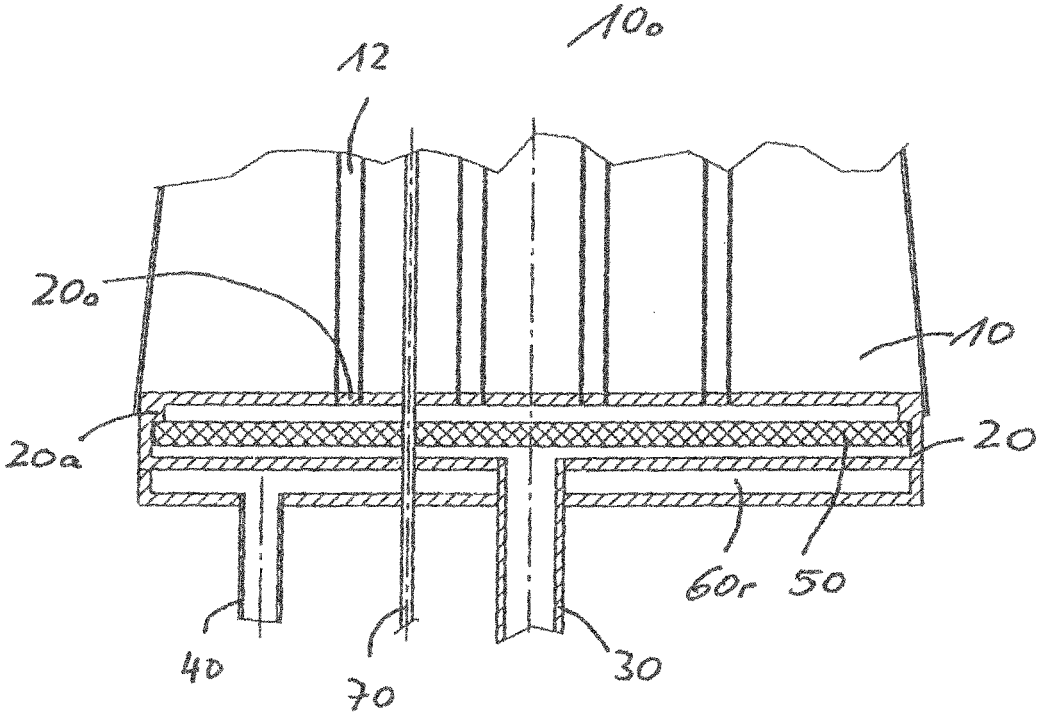

FIG. 4: as FIG. 3, but in use under normal gas pressure.

In the figures identical or similar acting parts are displayed with the same numerals.

The refractory ceramic gas purging element according to FIGS. 1, 2 represents the following features:

A refractory ceramic body 10 of frustoconical shape, only the lower part of which is displayed, and which extends in an axial direction A-A of the gas purging element between a first (lower) end 10*u* and an upper end (schematically displayed by 10*o*).

In said axial direction A-A channels 12 extend trough the ceramic body 10, which therefore features a directed porosity.

A chamber is arranged at a first end 10*u* of the body 10, which extends over the full cross-section of said body 10 at the lower end 10*u* and which is made of metal.

The chamber 20 comprises a closed bottom 20*b*, a circumferential wall 20*w* and a ceiling 20*d* with openings 20*o* in an extension of said channels 12.

In a transition region between wall 20*w* and ceiling 20*d* a circumferentially extending stopper (body stop) 20*a* is displayed on the inner side.

A gas feeding line enters into the middle part of bottom 20*b*.

At a distance to said gas feeding pipe 30 a further gas feeding pipe 40 is displayed, which is closed towards the inner part of chamber 20, as displayed in particular in FIG. 2, but which can be open as well.

Within said chamber 20 a refractory ceramic plate 50 is arranged, which lies on the bottom 20*b* of said chamber 20 according to FIG. 1 and which is dimensioned such that peripherally a gap exists between said plate 50 and said wall 20*w*.

The plate 50 features a so-called random porosity, i. e. a sponge-like inner structure, such that a gas, flowing in via said pipe 30, flows through the open porosity of plate 50.

The plate 50 is pushed upwardly (FIG. 2) under corresponding gas pressure, until it reaches its highest upper position, when said plate 50 abuts said stopper 20*a*.

As displayed in FIG. 2 even then a distance (clearance) exists between the upper side of plate 50 and the ceiling 20*d* of chamber 20, to allow a gas, which has flown into said space 20*r* through the plate 50 or between plate 50 and wall 20*w* may continue further from there through the openings 20*o* and channels 12 towards the (not displayed) metal melt.

If a chamber without cover/ceiling 20*d* is used, the distance between plate 50 and body 10 may be achieved by knobs, which protrude from the lower surface of body 10 between said channels 12.

The axial movability (articulation) of said plate 50 is assisted by a bar-shaped (rod-shaped) thermal element (thermocouple), which penetrates corresponding openings in said bottom 20*b*, in said plate 50, in said ceiling 20*d* and in said ceramic body 10 and finally ends there at a distance to the upper (not displayed) end 10*o* of the gas purging element.

The opening within said plate 50 is dimensioned such that the plate 50 can move without any problems in an axial direction A-A when the gas pressure is increased or lowered.

FIG. 2 displays the gas purging installation in a functional (use) position, FIG. 1 displays the situation if no gas flows in; the plate 50 then fulfills a security function by covering the gas feeding pipe 30.

The closure (cap) of the gas feeding pipe 40 can be dimensioned such it melts or will be disturbed when a certain temperature is exceeded in the area of the gas distribution chamber so that a cooling gas may flow via said pipe 40 into said chamber 20 to freeze the melt in case of a sudden temperature increase, for example caused by an infiltrating metal melt.

The thermal element 70 allows to measure the temperature at corresponding sections within the ceramic body 10. It may further be used to detect a certain wear situation or a metal infiltration in an indicative manner.

The embodiments according to FIGS. 3, 4 differ from said examples according to FIGS. 1, 2 insofar as an additional cooling space 60 follows said chamber 20, which space extends—as chamber—over the full cross-section of the lower end 10*u* of body 10, wherein the gas feeding pipe 40 has an open end in this embodiment. This allows to continuously cool the space 60 and at the same time to cool the bottom 20*b* of the chamber 20. Similarly to chamber 20 the cooling space 60 is defined by a metal box.

In the FIGS. 3, 4 the return pipes for the cooling gas are not displayed.

The invention claimed is:

1. Refractory ceramic gas purging element, comprising the following features:

a) the gas purging element has a refractory ceramic body (10), through which a gas can flow in an axial direction (A-A) of the gas purging element, between its first end (10*u*) and its second end (10*o*), b) a chamber (20) is arranged at the first end (10*u*) of the refractory ceramic body (10), which chamber extends over at least 50% of the cross section of the refractory ceramic body at its first end (10*u*), c) a gas feeding line (30) enters into said chamber (20), at a distance to said refractory ceramic body (10), d) at a section towards the refractory ceramic body (10) the chamber (20) is at least partially permeable to gas, e) in the chamber (20) at least one plate (50) is arranged, which is freely moveable in the axial (A-A) direction of the gas purging element between a first end position, being offset to the refractory ceramic body (10), and a second end position, being adjacent but at a distance to a section of the refractory ceramic body (10) which is permeable to gas, wherein f) the plate (50) one of:

abuts one or more stoppers (20*a*) in its second end position, thereby forming a free space (20*r*) between said plate (50) and the first end (10*u*) of the refractory ceramic body (10), or has at least one protruding stopper at its side adjacent to the refractory ceramic body (10), thereby forming a free space (20*r*) between said plate (50) and the first end (10*u*) of the refractory ceramic body (10) in its second end position, and g) the plate (50) is dimensioned, shaped and placed in the chamber (20) in such a way, that a gas flow from the gas feeding line (30) through said chamber (20) up to the first end (10*u*) of the refractory ceramic body (10) is even secured when the plate (50) is in its second end position.

2. Refractory ceramic gas purging element according to claim 1, the chamber (20) of which extends over at least 90% of the cross section of the refractory ceramic body (10) at its first end (10*u*).

3. Refractory ceramic gas purging element according to claim 1, the chamber (20) of which is made from a metal box.

4. Refractory ceramic gas purging element according to claim 1, the gas feeding line (30) of which merges into a section of the chamber (20), being opposite to the refractory ceramic body (10).

5. Refractory ceramic gas purging element according to claim 1, the plate (50) of which covers the gas feeding line (30) in its first end position.

6. Refractory ceramic gas purging element according to claim 1, the plate (50) abuts the one or more stoppers (20*a*) in its second end position, thereby forming the free space (20*r*) between said plate (50) and the first end (10*u*) of the refractory ceramic body (10).

7. Refractory ceramic gas purging element according to claim 1, the one or more stoppers protruding from the first end of the refractory ceramic body (10) towards the plate (50).

8. Refractory ceramic gas purging element according to claim 1, the one or more stoppers (20*a*) formed inside said chamber (20).

9. Refractory ceramic gas purging element according to claim 1, the plate (50) has the at least one protruding stopper at its side adjacent to the refractory ceramic body (10), thereby forming the free space (20*r*) between said plate (50) and the first end (10*u*) of the refractory ceramic body (10) in its second end position.

10. Refractory ceramic gas purging element according to claim 1, the plate (50) of which is at least partially gas permeable.

11. Refractory ceramic gas purging element according to claim 1, the plate (50) of which is made of a refractory ceramic material.

12. Refractory ceramic gas purging element according to claim 1, the chamber (20) of which is cooled.

13. Refractory ceramic gas purging element according to claim 1, the chamber (20) of which has at least one wall (20*b*) being a part of a cooling device.

14. Refractory ceramic gas purging element according to claim 1, the plate (50) of which has at least one opening, which is penetrated by a bar (70), extending in the axial direction (A-A) of the gas purging element, wherein the opening has a cross section, which is slightly larger than the cross section of the bar.

15. Refractory ceramic gas purging element according to claim 14, wherein the bar (70) is part of a device to indicate a residual thickness of the gas purging element.

* * * * *